United States Patent [19]

Nelson

[11] Patent Number: 4,667,856

[45] Date of Patent: May 26, 1987

[54] DISPENSER FOR ATTACHMENT TO LIQUID CONTAINERS

[76] Inventor: Marvin I. Nelson, 613 N. Washington, Dell Rapids, S. Dak. 57022

[21] Appl. No.: 817,844

[22] Filed: Jan. 10, 1986

[51] Int. Cl.[4] ..... B67D 1/10

[52] U.S. Cl. ..... 222/180; 215/280; 220/85 H; 220/322; 222/173; 222/209; 222/325; 222/379; 222/383; 222/384

[58] Field of Search ..... 222/173, 180, 325, 372, 222/379, 383, 184, 209, 153, 567, 382, 384; 220/85 H, 322; 248/139, 140; 215/280, 286; D9/443; 239/144

[56] References Cited

U.S. PATENT DOCUMENTS

| | | | |
|---|---|---|---|
| 122,718 | 1/1872 | Gee | 222/558 X |
| 328,115 | 10/1885 | Gilberds | 215/280 |
| 578,389 | 3/1897 | Challis | 220/322 X |
| 2,193,366 | 3/1940 | Hardwick | 220/85 H |
| 2,264,215 | 11/1941 | McClish | 222/385 X |
| 2,568,057 | 9/1951 | Cotter | 222/385 X |
| 2,660,338 | 11/1953 | Dunn | 222/385 X |
| 2,665,824 | 1/1954 | Anderson | 222/382 X |
| 2,680,477 | 6/1954 | Schira, Jr. | 222/209 X |
| 3,014,621 | 12/1961 | Povitz | 220/85 HX |
| 3,191,639 | 6/1965 | Jones | 222/385 X |
| 3,323,689 | 6/1967 | El More | 222/385 |
| 3,854,633 | 12/1974 | Bovaist | 222/325 X |
| 3,905,520 | 9/1975 | Nishioka | 222/383 X |
| 4,142,653 | 3/1979 | Mascia et al. | 222/325 X |
| 4,196,487 | 4/1980 | Merriman et al. | 215/286 X |
| 4,238,054 | 12/1980 | Chen | 222/209 X |
| 4,310,104 | 1/1982 | Takatsuki | 222/209 X |
| 4,386,556 | 6/1983 | Romey, Sr. | 222/209 X |
| 4,512,246 | 4/1985 | Chappell et al. | 222/209 X |
| 4,517,445 | 5/1985 | Tatsumi et al. | 222/209 X |
| 4,550,864 | 11/1985 | Tarozzi et al. | 222/209 |

FOREIGN PATENT DOCUMENTS

| | | | |
|---|---|---|---|
| 128987 | 9/1948 | Australia | 285/310 |
| 132407 | 8/1900 | Fed. Rep. of Germany | 215/86 |
| 1288754 | 12/1960 | France | 222/209 |
| 135362 | 4/1952 | Sweden | 222/209 |

*Primary Examiner*—Leslie J. Paperner
*Assistant Examiner*—P. McCoy Smith
*Attorney, Agent, or Firm*—B. Craig Killough

[57] ABSTRACT

A dispenser for attachment to liquid containers is disclosed which allows a contained liquid to be dispensed by pumping rather than pouring from the container, having a top cylinder containing a pump which is located over a mouth of the container, so that the mouth of the container contacts a gasket of relatively large surface area, and further having a base member pivotally attached to a top cylinder which is pivoted underneath the container to force the mouth of the container against the gasket to provide a seal. The relatively large surface area of the gasket and the design of the base member allow the device to be used with containers of varying size, and the seal achieved thereby allows pump of simple design to be incorporated.

4 Claims, 3 Drawing Figures

DISPENSER FOR ATTACHMENT TO LIQUID CONTAINERS

BACKGROUND AND SUMMARY OF THE INVENTION

This invention relates generally to a device for pumping of liquids and is more particularly directed to a pump device which may be attached to containers of varying sizes so as to allow the pumping of, rather than the pouring of, the liquid contents therefrom.

The background and utility of the present invention relates to a pump which may be attached to containers, including common beverage containers, so that the contents may be emptied from the container by manually pumping, rather than pouring, the contents from the container.

The pump device is designed so as to attach to milk containers, soft drink containers, and the like, of common size, so as to pump the contents from the container by manual means. The pump device disclosed herein is designed so as to be adaptable to various container sizes.

While it is contemplated that the device will commonly be used in conjunction with dispensing beverages, the device may also be used to empty many types of liquids from containers, including petroleum materials, liquid cleaning materials and the like. While it is further contemplated that the device commonly will be used with manual pump means, the pump means could also be powered by any commonly known means.

Summarily, the present invention has a dip tube which is connected to a pump means, although the particular pump means employed is not critical to the invention. The dip tube is placed through a top cylinder, and the dip tube is inserted into the container, with the top cylinder being placed over the opening of the container. A gasket placed between the under side of the top cylinder and the container aids in producing a seal. Each of two lugs on the top cylinder is then placed into a void on a vertical support of the base member, with the particular void in the supports chosen according to the height of the container. The lugs are rotatable within the voids, allowing the bottom of the base member to be rotated and forced underneath the container, in turn forcing the container, and particularly the mouth of the container, against the gasket. A seal between the top cylinder and the mouth of the container is now provided, and the material may be pumped from the container. Since the diameter of the top cylinder and the gasket are relatively large, the device may be used with containers having openings or mouths of varying sizes.

DETAILED DESCRIPTION OF THE DRAWINGS

DETAILED DESCRIPTION OF THE PREFERRED EMBODIMENT

Figure 3:
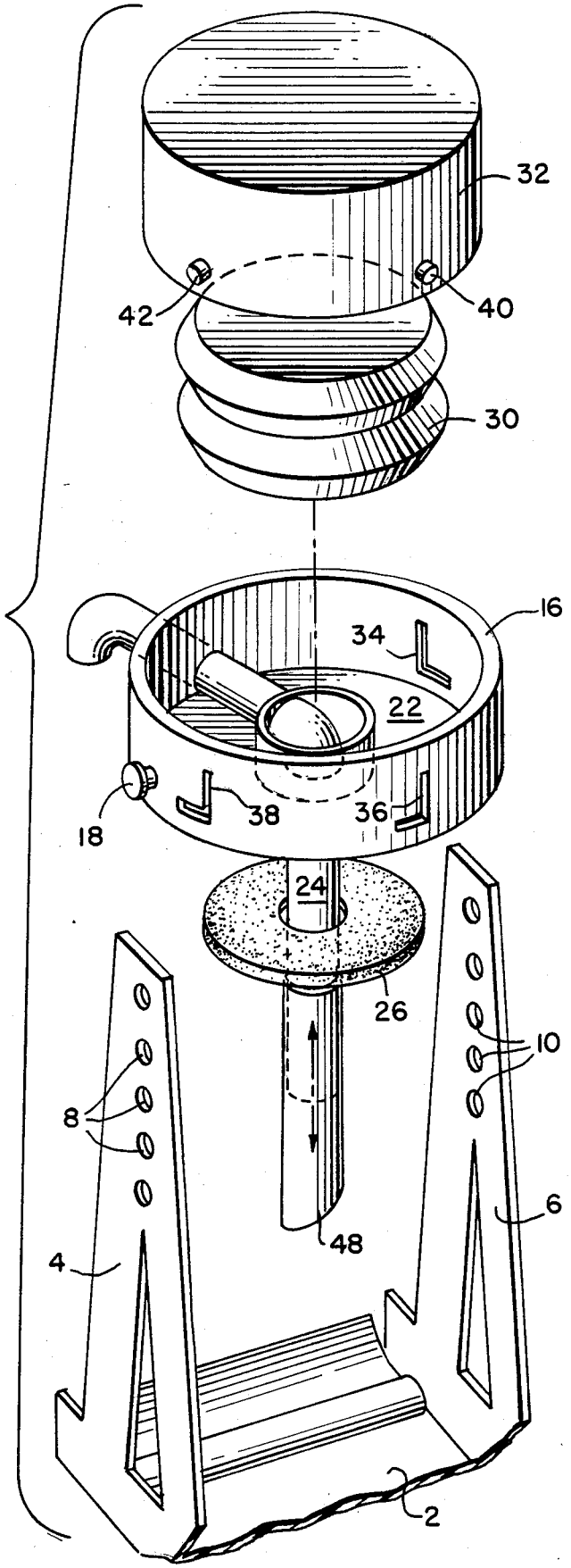
FIG. 3 is an exploded, perspective view of the device, showing the base member as a partial view.

In the preferred embodiment, the present invention has a base member 2 from which two vertical supports 4, 6 rise. On the upper portion of each of the vertical supports 4, 6 is a multiplicity of voids. The voids are closely spaced, and each vertical support has an equal number of voids, with each void in the first support corresponding to a void in the second support. As shown in FIG. 3, each support 4, 6 has five voids, with typical voids designated 8, 10. The particular number of voids may be varied according to need.

The lower portion of the base member 2 is generally rectangular when viewed from above, and may have three side walls, with one side being left open for positioning of the container 12. When the device is fully in position for use, the container 12 rests on the base portion 14, and is within the vertical support members 4, 6.

Figure 2:
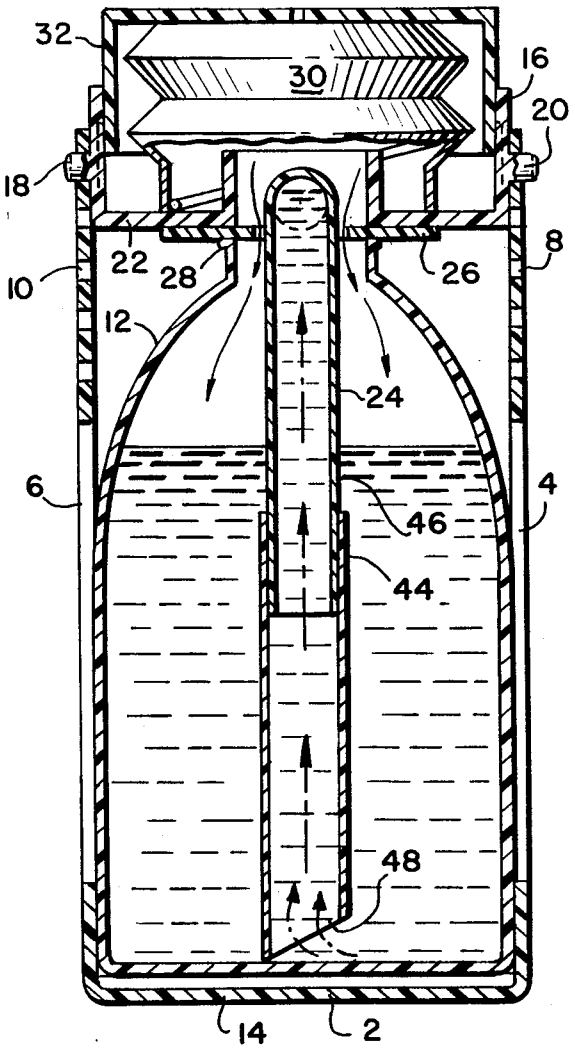
FIG. 2 is a side, sectioned view taken essentially along line 2—2 of FIG. 1.

A top cylinder 16 fits over the opening of the container 12 when the device is in position for use. Top cylinder 16 has two lugs 18, 20 which are opposite each other and which fit into the voids in the vertical supports as will be detailed further herein. The top cylinder 16 is generally cylindrical in shape but has a floor 22 therein. This floor 22 has a void through which a dip tube 24 passes, and through which air may be forced into the container for forcing liquid out through the dip tube. Air flow is shown in FIG. 2 by the downward pointing arrows, while liquid flow is shown through the dip tube 24 by upward pointing arrows. A gasket 26 fits against the underside of the floor 22 of the top cylinder 16, being generally circular in shape, and having a smaller circular void therein through which the dip tube 24 passes.

The invention is designed for use with containers of various shapes and sizes. The particular design, manner and method of attachment allow the device to be so used.

Figure 1:
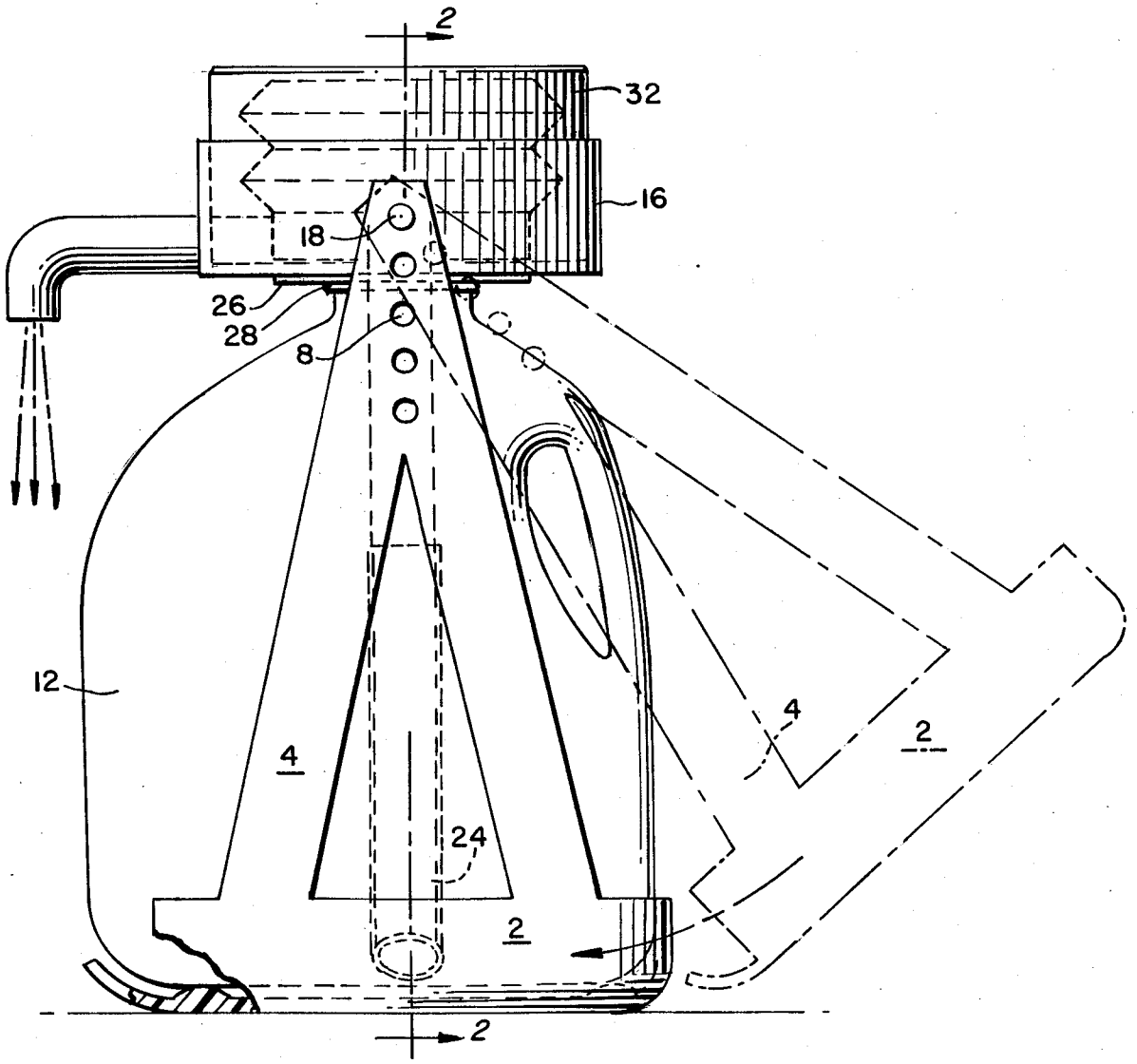
FIG. 1 is a side, elevated, action view showing the pivoting of the base member underneath a typical container so as to position the device for use.

Attachment of the device to the container is accomplished as shown in FIG. 1. The dip tube, shown as a phantom, is placed into the opening of the container 1, 2 and down into the container 12. The dip tube may be telescoping so as to allow the dip tube to extend to the bottom of the container. The gasket 26 rests against the opening 28 of the container, with the top cylinder 16 being located over the gasket 26. The lugs 18, 20 are now placed into the selected voids of the vertical supports, while the base member 2 is positioned at an angle to the side of the container. The particular set of voids which is selected is determined according to the height of the container. The base member 2 is then pivoted underneath the container, forcing the opening 28 of the container against the gasket 26 so as to accomplish an air-tight seal. If an air-tight seal is not accomplished, a lower set of voids must be chosen. If the base member cannot be forced underneath the container, a higher set of voids must be chosen.

Any type of pump may be used with the device. However, by accomplishing the air-tight seal at the opening of the container, a simple bellows-type pump 30 may be used. As shown in FIG. 2, the bellows-type pump forces air into the container, which causes the liquid to be forced through the dip tube and out of the container. A simple flap valve allows air to pass from the bellows into the container, but keeps the pressurized air from escaping from the container.

The bellows 30 may be covered with a cap 32 positioned into L-shaped locking slots 34, 36, 38 within the top cylinder 16. Lugs 40, 42 on the cap 32 are fitted into slots 34, 36, 38 to allow the cap to be locked down so as to reduce the height of the overall device for storage, such as in a refrigerator.

The device may be universally used with containers of varying height and size. The vertical supports 4, 6 are relatively widely spaced, and the gasket 26 surface is relatively large to allow the device to be used with containers of various widths or diameters, and having either large or small openings. The series or multiplicity of voids within the vertical support allows a wide range of selection as to the height of the container to be used, as does the telescoping dip tube.

The telescoping dip tube is accomplished by making the dip tube in two sections, the lower section 44 sliding over the upper section 46 in a frictional manner. The dip tube may be extended all the way, and as it is placed in a container, will adjust in height as the opening of the container is forced against the gasket. The bottom 48 of the dip tube 24 is shaped so as to allow liquids to freely enter the dip tube.

The device may be used to pump virtually any type of liquid. Virtually any type of pump may be incorporated. Because of the seal which the device provides about the mouth of the container, the device is particularly well-suited for simple pumps which force air into the container, forcing liquid out due to the pressure increase.

What is claimed is:

1. A liquid dispenser which may be attached to containers of various sizes, comprising:

a. a base member which fits underneath a container, having two vertical supports perpendicular to said base member, and having a series of voids of equal and corresponding number within each of said supports;

b. a top cylinder having two lugs thereon opposite each other which are selectively positioned in a pivotal fashion within said voids so as to allow said container to be placed underneath said top cylinder, and said base member to be pivoted into position under said container;

c. a gasket positioned between said top cylinder and said container against which a mouth of said container is forced by said base member so as to provide a seal when said base member is pivoted into position; and d. a pump means attached to said top cylinder.

2. A liquid dispenser which may be attached to containers of various sizes as described in claim 1, further comprising a telescoping dip tube which is attached to said pump means and which is inserted into said container through said mouth.

3. A liquid dispenser which may be attached to containers of various sizes as described in claim 1, further comprising a cap located over said pump means and having lugs thereon which are inserted into L-shaped slots within said top cylinder so as to allow said liquid dispenser to be reduced in overall height.

4. A liquid dispenser which may be attached to containers of various sizes as described in claim 2, further comprising a cap located over said pump means and having lugs thereon which are inserted into L-shaped slots within said top cylinder so as to allow said liquid dispenser to be reduced in overall height.

* * * * *